US008008588B2

(12) United States Patent
Kaida et al.

(10) Patent No.: US 8,008,588 B2
(45) Date of Patent: Aug. 30, 2011

(54) CONTACT SWITCH

(75) Inventors: Satoshi Kaida, Osaka (JP); Takao Matsui, Fukui (JP); Hirotaka Nawate, Fukui (JP)

(73) Assignee: Panasonic Corporation, Osaka (JP)

( * ) Notice: Subject to any disclaimer, the term of this patent is extended or adjusted under 35 U.S.C. 154(b) by 826 days.

(21) Appl. No.: 11/846,826

(22) Filed: Aug. 29, 2007

(65) Prior Publication Data

US 2008/0053799 A1 Mar. 6, 2008

(30) Foreign Application Priority Data

Aug. 29, 2006 (JP) ..... 2006-231739

(51) Int. Cl.
*H01H 13/14* (2006.01)

(52) U.S. Cl. ..... 200/285; 200/238

(58) Field of Classification Search ..... 200/285, 200/238, 239, 341, 329–332, 302.1–302.3, 200/262; 427/352–354; 428/141, 421
See application file for complete search history.

(56) References Cited

U.S. PATENT DOCUMENTS 5,324,566 A * 6/1994 Ogawa et al. ..... 428/141
6,290,233 B1 * 9/2001 Yamamura et al. ..... 277/410
2007/0013804 A1 * 1/2007 Noto ..... 348/335

FOREIGN PATENT DOCUMENTS

JP 2005-222754 8/2005

OTHER PUBLICATIONS

Mizumachi et al., "Surface Treatment Technology Handbook" Jun. 7, 2000, pp. 456-457, NTS Inc., w/partial translation.
Sumitomo 3M, "Brochure of Fluorine-Based Surface Treatment Agent, EGC-1720".

* cited by examiner

*Primary Examiner* — Renee S Luebke
*Assistant Examiner* — Marina Fishman
(74) *Attorney, Agent, or Firm* — RatnerPrestia

(57) ABSTRACT

A contact switch includes a case, a first contact provided in the case, a second contact provided in the case, an actuator for causing the first contact to contact the second contact, and an oil-repellent agent applied to at least one of an outer edge of the first contact or an outer edge of the second contact The oil-repellent agent includes a fluorine-based polymer. The switch has a simple structure and connects between the contacts reliably.

12 Claims, 3 Drawing Sheets

CONTACT SWITCH

FIELD OF THE INVENTION

The present invention relates to a contact switch including contacts, for use in an environment, such as automobiles, where oil, such as lubricant oil, exists.

BACKGROUND OF THE INVENTION

Various contact switches including contacts are used for turning on and off turn signal lamps for indicating directions of turn, stop lamps activated by a brake pedal, room lamps activated by a door.

A conventional contact switch includes a case and an actuator accommodated movably in the case. The actuator moves according to operations of a lever and a brake pedal or opening/closing of a door, and connects and disconnects between a movable contact and a fixed contact which have rivet shapes and face each other for turning on and off a lamp.

The contact switch is generally located near mechanisms, such as a steering assembly, a brake pedal, or doors, to which lubricants, such as grease or oil, are applied. Thus, the switch is used in locations unavoidable from dusts, moisture, and gases. Upon being used for a long period of time, the contacts may be prevented from contacting each other.

SUMMARY OF THE INVENTION

A contact switch includes a case, a first contact provided in the case, a second contact provided in the case, an actuator for causing the first contact to contact the second contact, and an oil-repellent agent applied to at least one of an outer edge of the first contact or an outer edge of the second contact The oil-repellent agent includes a fluorine-based polymer.

The switch has a simple structure and connects between the contacts reliably.

3 shows oil-repellent agent used in the contact switch according to the embodiment.

Figure 5:
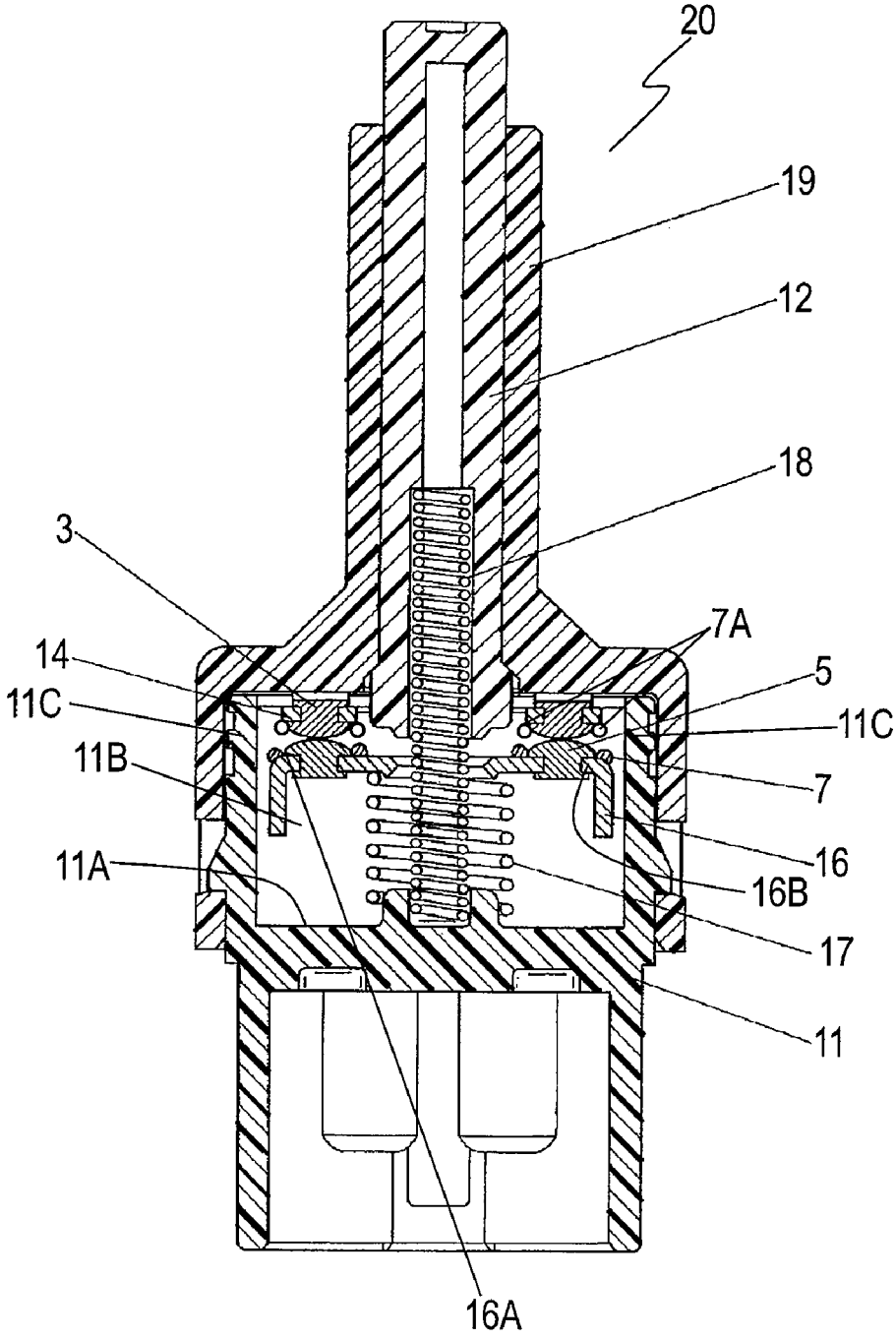

FIG. 5 is a cross-sectional view of another contact switch according to the embodiment.

DETAIL DESCRIPTION OF THE PREFERRED EMBODIMENTS

Figure 1:
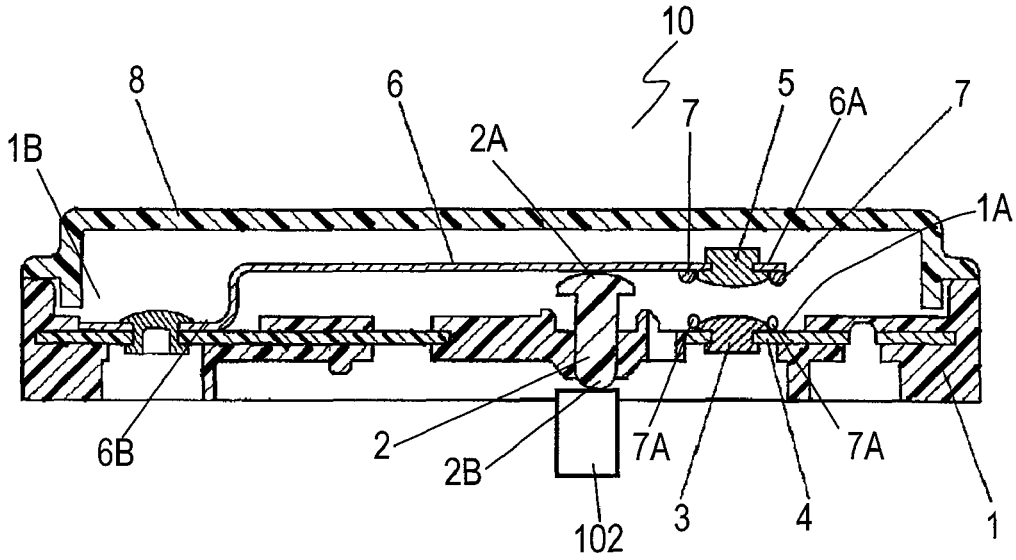
FIG. 1 is a cross-sectional view of a contact switch according to an exemplary embodiment of the present invention.

FIG. 1 is a cross sectional view of a contact switch 10 according to an exemplary embodiment for turning on and off a lamp, such as turn signal lamps and brake lamps. The switch 10 includes a case 1 made of insulating resin and an actuator 2 made of insulating resin. The case 1 has substantially a box shape. The actuator 2 has substantially a cylindrical shape. The case 1 has a recess 1B provided therein. The recess 1B has a bottom 1A. Second strips 4, fixed strips, are embedded in the bottom 1A of the case 1. Second strips 4 have second contacts 3, fixed contacts, mounted thereto, respectively. Each second contact 3 has a rivet shape made of metal, such as silver or copper apply. The second contacts 3 expose from the bottom 1A. Actuator 2 is accommodated in the recess 1B movably upward and downward.

A first contact 5, a movable contact, has a rivet shape made of metal, such as silver or copper alloy, and is fixed to end 6A of first strip 6, a movable strip, made of a thin plate of metal, such as copper alloy. End 6B of the first strip 6 is fixed to the bottom 1A of the case 1. End 2A of the actuator 2 contacts the first strip 6 between the ends 6A and 6B. The actuator 2 deflects first strip 6 upward, thereby causing the first contact 5 to face the second contact 3 by a gap. The first contact 5 and the second contact 3 project.

According to experiments, a cause was confirmed that prevents electrical connection between contacts after the conventional contact switch was used in an environment including relatively much dust, moisture, and gas. When turning on and off the lamp, in general, a relatively large current, about 10 A at 12V, flows in the contacts. When the switch is turned on and off, an arc may be produced between the contacts. When substance, such as a lubricant, enters in the switch and adheres to the contacts, the arc may produce carbide compound of the lubricant or silicon compound, thereby preventing the contacts from contacting each other.

In order to prevent the substance, such as lubricant, from entering in the conventional switch and to allow the contacts to contact each other stably, a case or an actuator of the switch is covered with a cover made of air-impermeable material, such as rubber, for sealing the switch. Alternately, the switch may be filled with inert gas which does not affect the contacts. However, such conventional switch has a complicated structure and accordingly, requires a long time to manufacture.

Figure 2:
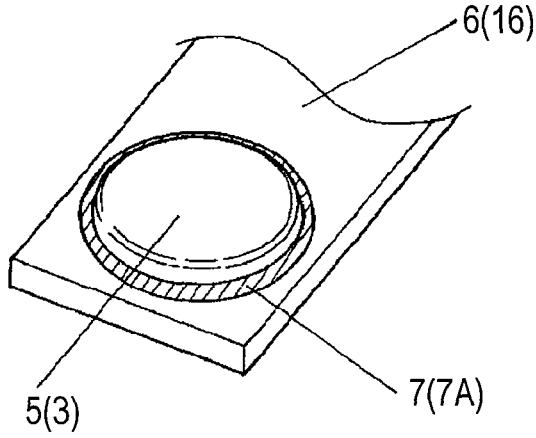
FIG. 2 is a perspective view of an essential part of the contact switch according to the embodiment.

The contact switch 10 according to the embodiment includes oil-repellent agent applied to respective peripherals of contacts 3 and 5 under consideration of the above cause. FIG. 2 is a perspective view of the first contact 5. An oil-repellent agent 7 is applied entirely onto an outer edge of the first contact 5 in a ring shape to surround the first contact 5. Similarly, an oil-repellent agent 7A is applied entirely onto an outer edge of the second contact 3 to surround the second contact 3 entirely.

Figure 3:
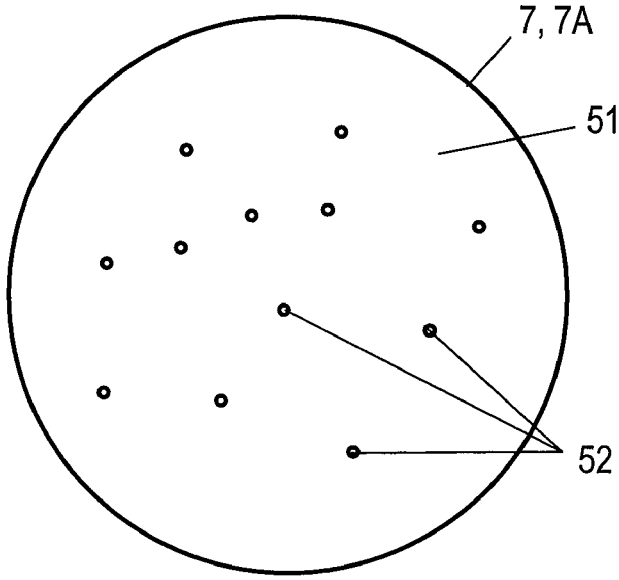
FIG. 3 shows oil-repellent agent used in the contact switch according to the embodiment.

FIG. 3 shows the oil-repellent agents 7 and 7A. Each of oil-repellent agents 7 and 7A contains dispersion medium 51 and fluorine-based polymer 52 dispersed in the medium 51. The dispersion medium 51 is made of mixture of methylnonafluoroisobutylether and methylnonafluorobutylether. Alternately, the dispersion medium 51 may be made of mixture of ethylnonafluoroisobutylether and ethylnonafluorobutylether.

Figure 4:
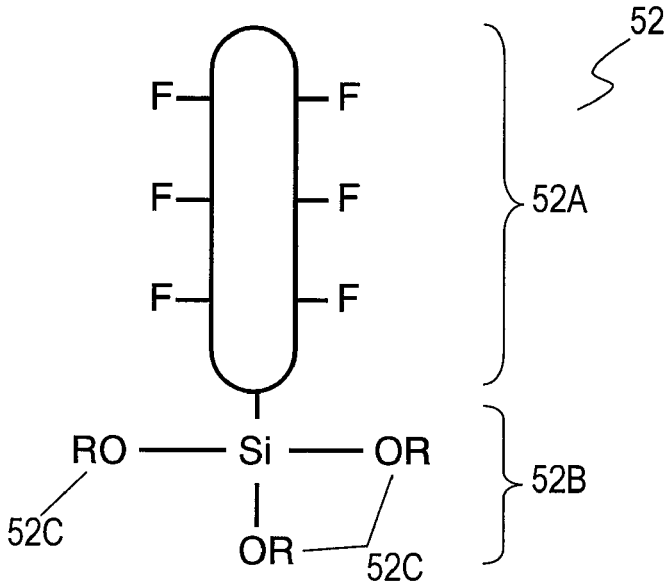
FIG. 4 is a schematic view of fluorine-based polymer in the oil-repellent agent according to the embodiment.

FIG. 4 is a schematic view of the fluorine-based polymer 52. The fluorine-based polymer 52 contains a fluorocarbon group 52A and organic functional group 52B coupled to the fluorine group 52A. The fluorocarbon group 52A is fluorine-based organic functional group having an oil-repelling function for repelling oil. The organic functional group 52A preferably contains hydrolysis groups 52C having silane-coupling function. One molecule of the fluorine-based polymer 52 contains two or three hydrolysis groups 52C.

Each of the contacts 3 and 5 and strip 6 and 16 which are made of metal generally has an oxidized layer on a surface thereof, and the oxidized layer includes hydroxyl ion. Around the contacts 3 and 5 and strip 6 and 16, plural fluorine-based polymers 52 are coupled to each other, and one of hydrolysis groups 52C of the organic functional group 52B of each fluorine-based polymer 52 is replaced by a hydroxyl ion. After the oil-repellent agents 7 and 7A are applied to respective portions of the strip 6 and 16 at peripheries of the contacts 3 and 5, the hydroxyl ion of the organic functional group 52B of each fluorine-based polymer 52 is coupled to the hydroxyl ion of the oxidized layer of each of the strip 6 and 16 by hydrogen bonding. Upon being left in a room temperature or heated, water is removed from the portion coupled by the hydrogen bonding, accordingly coupling the fluorine-based polymers 52 securely to the strip 6 and 16 by chemical bonding. Even if receiving an electrical stress, such as the arc or the large current, a temperature stress, and a mechanical stress, such as friction, the fluorine-based polymers 52 do nor remove from the periphery of the contact 3 or 5 or the portion of the strip 6 or 16, thus continuing to allow the fluorocarbon group 52A to perform the oil-repelling function sufficiently.

Cover 8 made of insulating resin covers the recess 1B of the case 1. An end 2B of the actuator 2 protrudes from the bottom 1A of the case 1. A lever made of insulating resin contacts the end 2B of the actuator 2, thus providing the contact switch 10.

The switch 10 is installed beneath a steering wheel. The second strip 4 and the first strip 6 are connected via a connector or a lead wire to an electronic circuit and a lamp of a vehicle.

When the lever 102 installed beneath the steering wheel is activated, the actuator 2 moves upward and downward, accordingly swinging the first strip 6 about the end 6A as a fulcrum. This operation connects and disconnects between the first contact 5 and the second contact 3, thereby turning on and off, for example, a turn signal lamp. That is, the actuator 2 allows the first contact 5 to contact the second contact 3 and to remove from the second contact 5.

The switch 10 is used in an environment, such as an automobile, where oil, such as lubricant, exists. Hence, the oil, such as lubricant, may enter into recess 1B from mechanisms which is located near the switch 10 and in which the oil exists. The oil-repellent agents 7 and 7A applied to the outer edges of the first contact 5 and the second contact 3 prevent the entering oil from being attached to the first contact 3 and the second contact 5.

Thus, the lubricant entering the switch 10 and then flowing along the first strip 6 and the second strip 4 is blocked by the oil-repellent agents 7 and 7A, thereby being prevented from reaching the first contact 5 and the second contact 3, respectively. This operation prevents the first contact 5 and the second contact 3 from having carbide and silicon compound produced by the arc during the contacting and removing between the contacts 3 and 5, thus allowing the contacts to contact each other reliably. Even if the oil-repellent agents 7 and 7A are attached to the contacts 3 and 5, the fluorine-based polymer 52 produces a thin film having a thickness of e.g. several nanometers which is attached onto the contacts 3 and 5, or the fluorine-based polymer 52 is attached sparsely onto the contacts 3 and 5, accordingly being prevented from affecting the electrical connection between the contacts 3 and 5.

The oil-repellent agents may be applied to the outer edges of the first contact 5 and the second contact 3 with a needle-type dispenser. The applied oil-repellent agent extends due to its surface tension along the outer edges of the first contact 5 and the second contact 3, and produces thin coats, thus producing the oil-repellent agents 7 and 7A easily.

Ten samples of The contact switch 10 according to the embodiment which includes the oil-repellent agents 7 and 7A and ten samples of a comparative contact switch which does not include the oil-repellent agent were evaluated in an accelerated test, in which the samples of these switches were turned on and off repetitively while lubricant was intentionally applied onto the strip 6 of each samples, and then it was determined whether or not the contact resistance between the contacts exceeded a predetermined value. The samples of the comparative contact switch included samples having the contact resistance exceeding the predetermine value after being tuning on and off about ten thousand times. In contrast, the samples of the contact switch 10 according to the embodiment did not include samples having the contact resistance exceeding the predetermined value even after being tuning on and off about thirty thousand times The oil-repellent agents 7 and 7A are applied to the first contact 5 and the second contact 3, respectively. Only one of the oil-repellent agents 7 and 7A may be applied, thereby the similar effects.

FIG. 5 is a cross sectional view of another contact switch 20 according to the embodiment for turning on and off stop lamps of the vehicle. The switch 20 includes a case 11 made of insulating resin and an actuator 12 made of insulating resin. The case 1 has substantially a box shape. The actuator 12 has substantially a circular column shape. The case 11 has a recess 11B provided therein. The recess 11A has a bottom 11A. Second strips 14, fixed strips, are embedded in an inner wall 11C of the case 1. Each second strips 14 has second contact 3, a fixed contact, fixed thereto. The second contact has a rivet shape made of metal, such as silver or copper apply. An actuator 2 is accommodated in the recess 11B movably upward and downward.

First contacts 5, movable contacts, have rivet shapes made of metal, such as silver or copper alloy, and are fixed to both ends 16A and 16B of first strip 16, a movable strip, is made of a thin metal plate made metal, such as copper alloy, respectively. A coil spring 17 is located between the first strip 16 and the bottom 11A of the case 11 while being compressed slightly. The spring 17 urges first contacts 5 upward towards the second contacts 3, thereby allowing the first contacts 5 to be connected electrically via the first strips 16 to the second contacts 3, respectively. The first contact 5 and the second contact 3 project.

The oil-repellent agents 7 and 7A are applied to the outer edges of the first contact 5 and the second contact 3, respectively. As shown in FIGS. 3 and 4, each of the oil-repellent agents 7 and 7A contains dispersion medium 51 and the fluorine-based polymer 52 dispersed in the medium 51. The polymer 52 contains the fluorocarbon group 52A and the organic functional group 52B. The oil-repellent agents 7 and 7A are applied entirely onto the outer edges of the first contact 5 and the second contact 3 to surround the first contact 5 and the second contact 3 entirely in a substantial ring shape.

A restoring coil spring 18 is located between a lower end of the actuator 12 and the bottom 11A of the case 11 while being compressed slightly. The recess 11B of the case 11 is covered with cover 19 made of insulating resin. The restoring spring 18 urges the actuator 12 upward. An upper end of the actuator 12 projects upward from a tubular portion of the cover 19, thus providing the contact switch 20.

The switch 20 is accommodated in front of a brake pedal. The second strips 14 and the first strip 16 are connected via connectors and lead wires to electronic circuits and lamps of a vehicle.

The brake pedal is depressed, and accordingly, moves the actuator 12 of the switch 20 downward and upward. The first strip 16 accordingly moves downward while causing the springs 17 and 18 to deform. This operation connects and disconnects between the first contact 5 and the second contact 3, accordingly turn on and off the stop lamp. That is, the actuator 12 allows the first contact 3 to contact the second contact 5 and to remove from the second contact 5.

The switch 20 is used in an environment, such as an automobile, where oil, such as lubricant, exists. Hence, the oil, such as lubricant, may enter into recess 1B from mechanisms which is located near the switch 10 and in which the oil exists. Similarly to the switch 10 shown in FIGS. 1 and 2, the oil-repellent agents 7 and 7A applied to the outer edges of the first contact 5 and the second contact 3 prevent the entering oil from being attached to the first contact 3 and the second contact 5.

Thus, the lubricant entering the switch 20 and then flowing along the first strip 6 and the second strip 4 is blocked by the oil-repellent agents 7 and 7A, thereby being prevented from reaching the first contact 5 and the second contact 3, respectively. This operation prevents the first contact 5 and the second contact 3 from having carbide and silicon compound produced by the arc during the contacting and removing between the contacts 3 and 5, thus allowing the contacts to contact each other reliably.

In the switch 20, the oil-repellent agents 7 and 7A are applied to the first contact 5 and the second contact 3, respectively. Only one of the oil-repellent agents 7 and 7A may be applied, similarly to switch 10, thereby the similar effects.

The switches 10 and 20 activated by pushing for turning on and off turn signal lamps and stop lamps in the vehicle are described. The oil-repellent agents 7 and 7A are applicable to any types of contact switches, such as rotary and sliding switches, e.g. a door switch for turning on and off a room lamp when a door is opened and closed, and further applicable to contacts of relays and to brushes of motors, providing the same effects.

What is claimed is:

1. A contact switch adapted to be used in an environment where a lubricant oil exists, said contact switch, comprising:

a case to allow the lubricant oil to exist therein;

a first strip provided in the case, the first strip allowing the lubricant oil to flow along the first strip;

a first contact provided on the first strip and in the case;

a second contact provided in the case;

an actuator for causing the first contact to contact the second contact; and a first oil-repellent agent applied to an outer edge of the first contact, the first oil-repellent agent including a fluorine-based polymer;

wherein the first oil-repellent agent surrounds the first contact entirely to prevent the lubricant oil flowing along the first strip from reaching the first contact.

2. The contact switch according to claim 1, further comprising a second oil-repellent agent applied to an outer edge of the second contact, the second oil-repellent agent including fluorine-based polymer.

3. The contact switch according to claim 1, wherein the second oil-repellent agent surrounds the outer edge of the second contact.

4. The contact switch according to claim 1, wherein the first oil-repellent agent further includes a dispersion medium and the fluorine-based polymer is dispersed in the dispersion medium.

5. The contact switch according to claim 4, wherein the dispersion medium includes a mixture of methylnonafluoroisobutylether and methylnonafluorobutylether.

6. The contact switch according to claim 4, wherein the dispersion medium includes a mixture of ethylnonafluoroisobutylether and ethylnonafluorobutylether.

7. The contact switch according to claim 1, wherein the hydrolysis group has a silane-coupling function.

8. The contact switch according to claim 1, wherein the fluorine-based polymer is coupled to the outer edge of the first contact by chemical bonding.

9. The contact switch according to claim 1, wherein plural fluorine-based polymers are coupled to each other.

10. The contact switch according to claim 1, wherein the organic functional group contains two or three hydrolysis groups.

11. The contact switch according to claim 1, wherein the fluorine-based polymer contains a fluorine-based organic functional group, and an organic functional group coupled to the fluorine-based organic functional group, the organic functional group containing a hydrolysis group.

12. The contact switch according to claim 2, wherein the fluorine-based polymer is coupled to the outer edge of the second contact by chemical bonding.

* * * * *